US005387135A

United States Patent [19]

Shen et al.

[11] Patent Number: 5,387,135

[45] Date of Patent: Feb. 7, 1995

[54] SPECIAL PURPOSE MODULAR RECEPTACLE JACK

[75] Inventors: David W. Shen, Cupertino; Robert A. Howard, Mountain View; Robert A. Riccomini, Saratoga; Steven J. Young, Milpitas, all of Calif.; Robert E. L. Cox, Croissy-sur-Seine; Philippe Le Bars, Elancourt, both of France; Keiichi Tsukinari, Mission Viejo, Calif.

[73] Assignee: Apple Computer, Inc., Cupertino, Calif.

[21] Appl. No.: 73,724

[22] Filed: Jun. 9, 1993

[51] Int. Cl.[6] ..... H01R 23/02

[52] U.S. Cl. ..... 439/676

[58] Field of Search ..... 439/676, 660, 692–697

[56] References Cited

U.S. PATENT DOCUMENTS

| | | | |
|---|---|---|---|
| 3,963,300 | 6/1976 | Patton et al. | 439/676 |
| 4,103,985 | 8/1978 | Krolak et al. | 439/676 |
| 4,225,209 | 9/1980 | Hughes | 439/676 |
| 4,290,664 | 9/1981 | Davis et al. | 439/676 |
| 4,362,905 | 12/1982 | Ismail | 439/676 |
| 4,493,951 | 1/1985 | Sandersson et al. | 439/676 |
| 4,655,522 | 4/1987 | Beck, Jr. et al. | 439/676 |
| 4,699,443 | 10/1987 | Goodrich et al. | 439/676 X |
| 5,037,320 | 8/1991 | Stolte | 439/676 X |
| 5,118,311 | 6/1992 | Margini | 439/676 |
| 5,118,312 | 6/1992 | Lu | 439/676 |
| 5,244,402 | 9/1993 | Pasterchick et al. | 439/676 X |

*Primary Examiner*—Eugene F. Desmond
*Attorney, Agent, or Firm*—Greg T. Sueoka

[57] ABSTRACT

A special purpose modular receptacle comprises a generally rectangular housing having an opening which exposes a cavity within the housing. A plurality of electrical contacts are disposed within the cavity of the housing. Terminal ends of the contacts electrically connect to corresponding contacts on a standard modular connector or a modified modular connector inserted into the cavity. The contacts are exposed at a lower rear portion of the housing allowing connection between the contacts and a printed circuit board. Attachment means allow physical and electrical connection of the housing to a printed circuit board. A guiding means may be present as a modular connector insertion aid.

21 Claims, 2 Drawing Sheets

SPECIAL PURPOSE MODULAR RECEPTACLE JACK

CROSS-REFERENCE TO RELATED APPLICATIONS

This application relates to U.S. patent application Ser. No. 08/068,868 entitled "Special Purpose Modular Connector Plug", filed May 28, 1993.

BACKGROUND OF THE INVENTION

1. Field of the Invention

The present invention relates generally to receptacle/jack portions of electrical connectors, and more particularly, to a special purpose modular receptacle jack providing at least two separately accessible sets of contacts, and selectively mating with either a modified modular plug/connector or a standard modular plug/-connector.

2. Description of the Background Art

Telecommunications equipment has benefited from the design of electrical plugs (connectors) and jacks (receptacles) that provide easy connect/disconnect capability between electrical circuits within the telecommunications equipment. Such plugs and jacks are particularly popular in association with telephone sets where they were first used. Modular plugs and jacks have been so well received that their specifications are standardized, and can be found in Subpart F of the FCC-Part 68.500 Registration Rules.

Modular jacks provide a convenient means for connecting and disconnecting telephone equipment, telecommunications equipment, and computer-related equipment. Common modular receptacles conventionally comprise between two and eight contacts embedded within a generally rectangular plastic housing having a cavity capable of receiving a modular plug. Portions of each contact are exposed within the cavity, thus allowing electrical connection to corresponding contact; on a modular plug. In addition, attachment portions of each contact extend beyond the housing, allowing electrical connection between the receptacle contacts and a printed circuit board.

The design standardization of common modular receptacles allows equipment utilizing such receptacles to be interchangeably connected to a single plug. This feature is beneficial with respect to telephone plugs and jacks, because it allows phone units to be moved from room to room or from house to house without requiring modification of the corresponding receptacles. However, computer manufacturers often want to have their equipment selectively connected to a predetermined plug. It is desirable to provide a jack having an increased number of contacts which would allow additional electrical components to be connected through a special purpose modular plug, while also allowing connection to a standard modular plug.

SUMMARY OF THE INVENTION

The present invention is a modular receptacle or jack providing at least two separately accessible sets of contacts disposed within a housing having a special design for receiving a standard modular plug or a specially modified modular plug with additional contacts. The presence of at least two sets of contacts in the modular electrical receptacle allows connection to more than one electrical component.

The modular receptacle jack of the present invention preferably comprises a generally rectangular housing forming a main cavity having two recessed regions. A first set of electrical contacts are disposed within the main cavity, while second and third sets of contacts are respectively disposed within the recessed regions. A standard modular connector may be inserted into the cavity and utilizes only the first set of contacts. Alternatively, a modified modular connector may be inserted into the cavity to utilize two or more sets of contacts within the receptacle. Attachment ends of the contacts are disposed at a lower rear portion of the housing, allowing electrical connection between the contacts and external circuitry such as a printed circuit board.

DETAILED DESCRIPTION OF THE PREFERRED EMBODIMENTS

Figure 1:
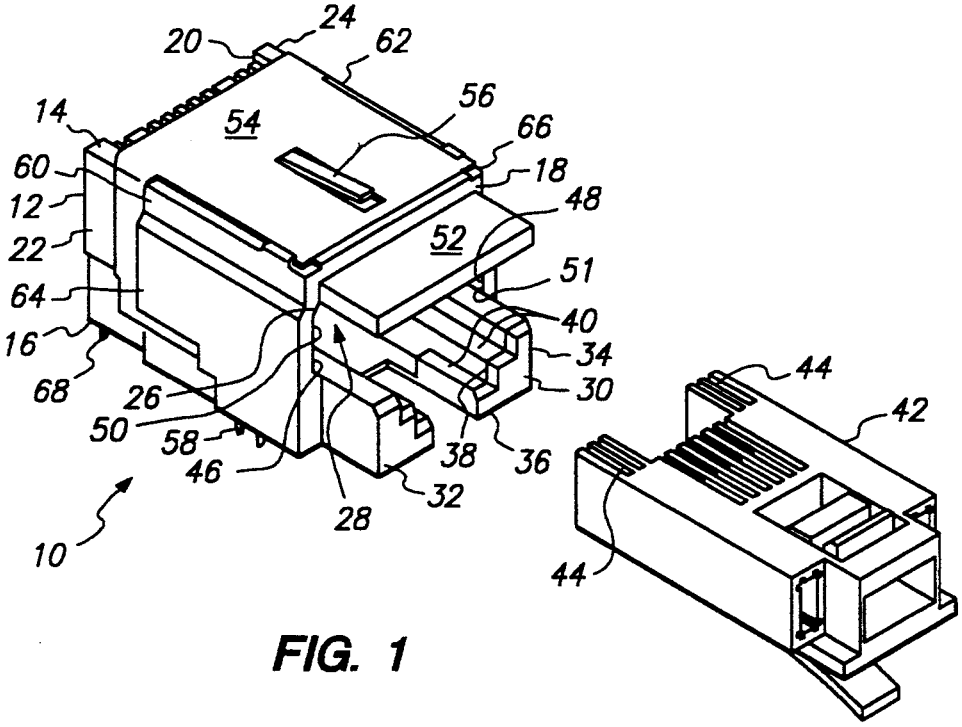
FIG. 1 is a perspective view of a first and preferred embodiment of a special purpose modular receptacle constructed in accordance with the present invention, showing a modified modular connector prior to insertion into the receptacle.

FIG. 1 shows a perspective view of a preferred embodiment of a special purpose modular receptacle (jack) 10 constructed in accordance with the present invention. A generally rectangular housing 12 of glass-filled polyester has a top side 14, a bottom side 16, a front side 18, a rear side 20, a right side 22, and a left side 24. An opening 26 formed at the front side 18 exposes a cavity 28 within the housing 12. Left and right foot members 30, 32 are formed from the lower front portion of the front side 18 and extend forward. The left foot member 30 is a forward extension of a portion of the front side 18, bottom side 16, and left side 24 of the housing 12. The right foot member 32 is a forward extension of a portion of the front side 18, bottom side 16, and right side 22. Each foot member 30, 32 is generally triangular and has an outer side 34, a base side 36, and an inner side 38. The outer side 34 is disposed at a right angle with respect to the base side 36, and the inner side 38 includes a plurality of steps 40.

In an alternate embodiment, the receptacle may be modified so that a standard RJ-11 plug cannot be inserted into the receptacle. In certain instances, the telecommunications operators and authorities may not want to allow the computer user to connect a line interface directly to their networks. The alternate embodiment of the receptacle modifies one of the foot members 30 by removing the upper step. This upper step corresponds to the bottom corner of a standard RJ-11 plug, and thereby prevents the insertion of such a plug into the receptacle. The upper step is preferably removed by providing an removable insert that fills the step in the cavity.

A corresponding modified modular connector 42 houses additional contacts 44 and is therefore wider than a standard modular connector. An example of such a connector is described in U.S. patent application Ser. No. 08/068,868 entitled "Special Purpose Modular Connector Plug," which is incorporated herein by reference. The jack 10 of the present invention allows for the increased width of the modified modular connector 42 by defining a first and a second channel 46, 48. The first and second channels 46, 48 are formed horizontally along an inner surface 50 of the right side 22 and an inner surface 51 of the left side 24 of the housing 12, respectively. The channels 46, 48 extend from the front side 18 to proximate the rear side 20. A rectangular awning 52 extends forward from the front side 18 of the housing 12, parallel with the top side 14. The awning 52, the first and second channels 46, 48, and the steps 40 of the right and left feet 30, 32 provide a guiding means for alignment of a connector during insertion into the jack 10.

Shielding 54 surrounds portions of the right side 22, top side 14, and left side 42 of the housing 12. A narrow contact tab 56 cut from a portion of the shielding 54 covering the top side 14 of the housing 12 is bent upward relative to the plane of the top side 14. The contact tab 56 assists in securing physical contact between the shielding 54 and additional optional shielding (not shown).

The portions of shielding 54 which cover the right and left sides 22, 24 of the housing 12 further include legs 58 which extend below the plane of the bottom side 16 of the housing 12. The legs 58 serve as a means for securing the jack 10 to a printed circuit board (not shown) as well as providing a means for electrically grounding the shielding 54. The jack 10 is attached to a printed circuit board by compressing the legs 58 together and inserting them into corresponding holes formed in the printed circuit board. Upon release, the legs 58 resiliently open, resulting in an interference fit of the legs 58 within the holes thus providing a secure mounting of the jack 10 to the printed circuit board. After the jack 10 has been mounted, the shielding 54 can be grounded by soldering the legs 58 to the ground section of the printed circuit board.

Attachment ends 68 of the contacts (not shown) are exposed at the rear side 20 of the housing 12 and extend below the plane of the bottom side 16. Mounting the jack 10 on a printed circuit board causes insertion of the attachment ends 68 of the contacts into corresponding holes in the printed circuit board and soldered, thereby providing electrical contact between the jack 10 and the printed circuit board.

Although mounting the preferred embodiment of the jack 10 onto a printed circuit board requires through-holes in the printed circuit board, a surface-mount version is anticipated in which the jack 10 and the attachment ends 68 of the contacts are attached, preferably soldered, directly to the printed circuit board surface without the benefit of holes. Those skilled in the art will also realize that galvanic isolation between the contacts can be provided although none is shown in the preferred embodiment.

Formation of the first and second channels 46, 48 results in a thickness reduction in the right and left sides 22, 24 of the housing 12. In order to compensate for this thickness loss, the right and left outer sides 60, 62 of the housing 12 are fabricated with respective thickened portions 64, 66.

Figure 2:
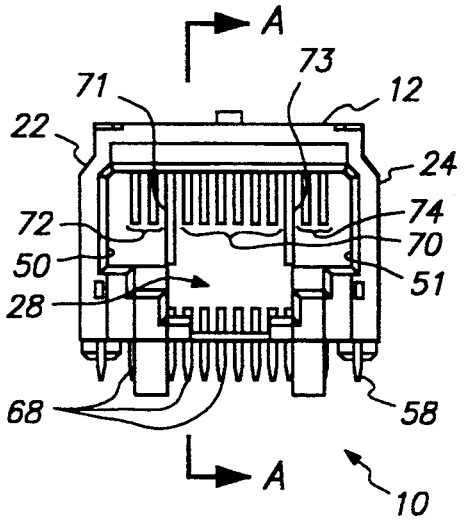
FIG. 2 is a front view of the receptacle of FIG. 1 illustrating the disposition of a primary set plus two additional sets of contacts within the housing.

FIG. 2 is a front view of the jack 10 of FIG. 1, illustrating the placement of a first set 70 of contacts plus an auxiliary second and third additional set 72, 74 of contacts within the cavity 28. The first set 70 of contacts is centrally disposed within the cavity 28 between the right and left cavity partitions 71, 73 which serve to separate the rear of the cavity 28 into distinct regions. The second additional set 72 of contacts is disposed between the right cavity partition 71 and the inner surface 50 of the right side 22 of the housing 12, and is recessed to the rear from the plane of the first set 70 of contacts. In like manner, the third additional set 74 of contacts is disposed between the left cavity partition 73 and the inner surface 51 of the left side 24 of the housing 12, and is recessed toward the rear side 20 from the plane of the first set 70 of contacts. The first set 70, the second additional set 72, and the third additional set 74 of contacts are disposed in parallel with each other and with the longitudinal axis of the housing 12.

Figure 3:
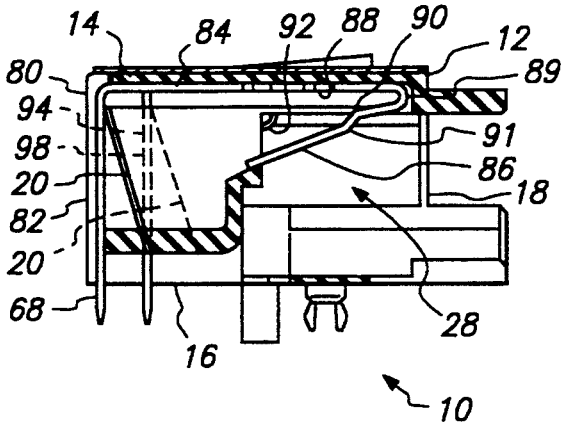
FIG. 3 is a cross-sectional side view of the receptacle of FIG. 1 taken along line A—A, illustrating the shape and disposition of an exemplary contact within the housing.

FIG. 3 is a cross-sectional view of the jack 10 taken along line A—A of FIG. 1, and showing the shape and disposition of an exemplary first contact 80. The rear side 20 of the housing 12 is disposed at an angle with respect to the top side 14 and bottom side 16, and slopes inwardly toward the center of the cavity 28 as it extends from the top side 14 to the bottom side 16. The exemplary first contact 80 includes an attachment end 68, a back portion 82, a top portion 84, and a terminal end 86. The attachment end 68 of the exemplary first contact 80 is disposed below the plane of the housing's 12 bottom side 16. The back portion 82 is disposed vertically proximate the rear side 20 of the housing 12. The top portion 84 of the exemplary first contact 80 extends from the rear side 20 to the front side 18 of the housing 12, in parallel with and adjacent to an inner surface 88 of the top side 14 of the housing 12. A first bend 89 causes the terminal end 86 of the exemplary first contact 80 to extend toward the bottom side 16 and rear side 20 of the housing 12 at an angle of approximately 40 degrees. Second and third bends 90, 91 form a small s-shaped curve in the terminal end 86, further lowering the terminal end 86 towards the bottom side 16 of the housing 12. The first 89, second 90, and third 91 bends properly dispose the terminal end 86 of the exemplary first contact 80 for engagement with a corresponding contact on a plug (not shown) when the plug is inserted into the jack 10. Such engagement provides an electrical connection between the jack 10 and the plug.

Also shown in FIG. 3 is a portion of the terminal end 92 of an exemplary additional contact 94 from the third additional set 72 of contacts (FIG. 2). The disposition of the exemplary additional contact 94 is offset with respect to the plane of the terminal end 86 and the plane of the back portion 82 of the exemplary first contact 80. The dashed lines illustrate the back portion 98 of the exemplary additional contact 94 and the recessed location of the sloping rear side 20 of the housing 12 concomitant with the exemplary additional contact 94.

Figure 4:
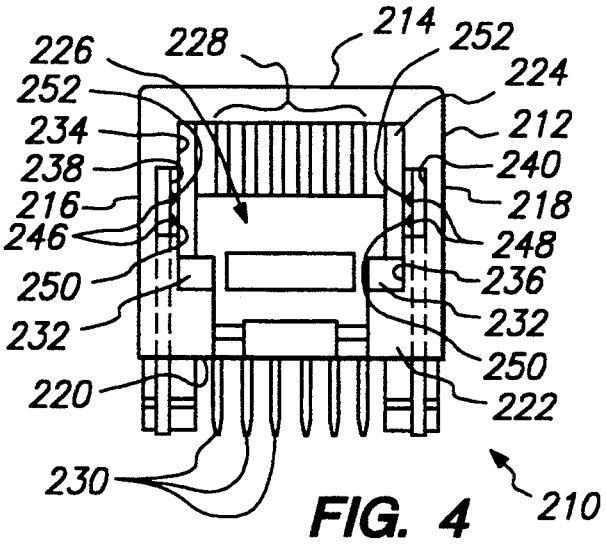
FIG. 4 is a front view of a second embodiment of a special purpose modular receptacle of the present invention, where a pair of additional contacts is disposed along the inner surface of each side wall of the housing.

FIG. 4 is a front view of a second embodiment 210 of a special purpose modular receptacle constructed in accordance with the present invention. A generally rectangular housing 212 includes a top side 214, a right side 216, a left side 218, a bottom side 220, and a front side 222. An opening 224 formed in the front side 222 exposes a cavity 226 within the housing 212. A first set 228 of contacts is centrally disposed proximate the top side 214 of the housing 212. The attachment ends 230 of the first set 228 of contacts are disposed below the bottom side 220 of the housing 212 and provide a means for electrically connecting the jack 210 to a printed circuit board (not shown). A pair of guide rails 232 are formed along the right and left inner surfaces 234, 236 of the right and left sides 216, 218, respectively. These guide rails 234, 235 aid in proper alignment of a plug during insertion into the jack 210.

The housing 212 further defines first and second channels 238, 240. The first channel 238 is disposed horizontally on the inner surface 234 of the right side 216 of the housing 212. The second channel 240 is likewise disposed on the inner surface 236 of the left side 218. A second additional set 246 and a third additional set 248 of contacts are disposed in the first and second channel 238, 240, respectively. The second additional set 246 of contacts comprises a first contact member 250 and a second contact member 252, where the disposition of the first contact member 250 is shifted toward the front side 222 of the housing 212 relative to that of the second contact member 252. The third additional set 248 of contacts likewise comprises a first contact member 250 and a second contact member 252 with corresponding disposition.

Figure 5:
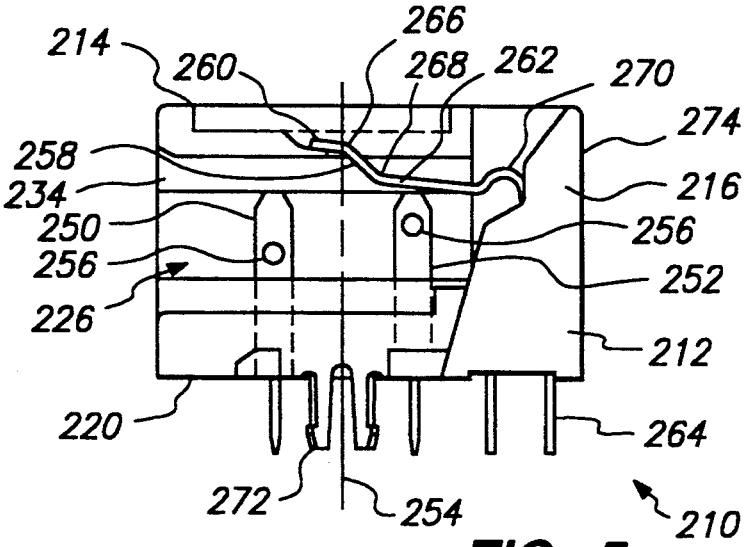
FIG. 5 is a partial cross-sectional side view of the receptacle illustrated in FIG. 4, showing the positioning of the additional contacts on the inner surface of the right side of the housing.

FIG. 5 is a partial cross-sectional view of the second embodiment 210 for the receptacle of FIG. 4, illustrating the disposition of the first and second contact members 250, 252 on the inner surface 234 of the right side 216 of the housing 212. The first contact member 250 is disposed vertically on the inner surface 234 forward from a vertical centerline 254 of the housing 212. The second contact member 252 is disposed vertically on the inner surface 234 to the rear of the vertical centerline 254. The vertical centerline 254 is equidistant between the first and second contact members 250, 252. The first and second contact members 250, 252 are comprised of generally rectangular plates of a conductive material such as brass, each having a raised portion 256 which engages a corresponding contact on a modified modular connector (not shown) mated with the jack 210. As illustrated, the raised portion 256 of the first contact member 250 is vertically offset from the raised portion 256 of the second contact member 252.

An exemplary first contact 258 comprises a terminal end 260, an engagement portion 262, and an attachment end 264. The terminal end 260 is disposed at a position proximate the top side 214 of the housing 212 and includes a first bend 266 which directs the contact 258 downward into the cavity 226. A second bend 268 directs the engagement portion 262 of the exemplary first contact 258 along a nearly-horizontal slope toward the rear side 274 of the housing 212. The engagement portion 262 of the exemplary first contact 258 electrically connects to a corresponding contact on a modular plug (not shown) inserted into the jack 210. The engagement portion 262 also includes a third bend 270 which directs the attachment end 264 of the exemplary first contact 258 into a generally vertical disposition proximate the rear side 274 of the housing 212. The attachment end 264 of the exemplary first contact 258 is disposed below the bottom side 220 of the housing 212 and mates with corresponding holes in a printed circuit board (not shown). Legs 272 formed at the lower portion of the right side 216 and lower portion of the left side 218 (FIG. 4) of the housing 212 provide a means for fastening and grounding the jack 210 to a printed circuit board.

Figure 6:
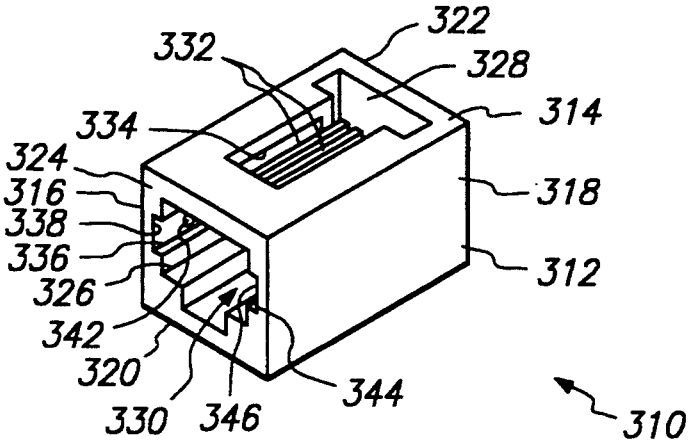
FIG. 6 is a perspective view of a third embodiment of a special purpose modular receptacle of the present invention, showing a modified receptacle having two pair of additional contacts disposed within channels formed on the inner surface of the housing.

FIG. 6 is a perspective view of a third embodiment 310 of a special purpose modular receptacle in accordance with the present invention. A generally rectangular housing 312 has a top side 314, a right side 316, a left side 318, a bottom side 320, a rear side 322, and a front side 324. A first opening 326 is formed at the front side 324 and a second opening 328 is formed at the top side 314 of the housing 312. The first and second openings 326, 328 expose a cavity 330 within the housing 312. A first set 332 of contacts is disposed proximate the rear side 322 of the housing, parallel to the plane of the inner surface 334 of top side 314 of the housing 312. A first channel 336 is disposed horizontally on the inner surface 338 of the right side 316, wherein a second additional set 342 of contacts is disposed in parallel horizontal alignment and staggered vertically. A second channel 344 and a third additional set of contacts (not shown) are likewise disposed on the inner surface 346 of the left side 318 of the housing 312.

The second additional set 342 of contacts and the third additional set of contacts engage corresponding contacts in outwardly extending side arm portions of a modified modular connector (not shown). Upon insertion of such a connector into the jack 310, the contacts on the leading edge of the connector will engage the first set 332 of contacts within the jack 310, and the additional contacts within the side arm portions of the connector will engage the second additional set 342 and third additional set of contacts within the first and second channels 336, 344 of the jack 310. If a standard modular connector (not shown) were inserted into the jack 310, only the first set 332 of contacts would be engaged.

While the present invention has been described with reference to certain preferred embodiments, those skilled in the art will recognize that various modifications may be provided. For example, modifications might include, but would not be limited to, an embodiment in which only one additional set of contacts is present; or an embodiment in which additional or fewer individual contacts may be present within any or all sets of contacts. These and other variations upon and modifications to the preferred embodiment are provided for by the present invention which is limited only by the following claims.

We claim:

1. A special purpose modular receptacle jack for coupling with either a standard male connector plug or a modified male connector plug, the receptacle jack comprising:

a housing having a first end, a second end, a first side, a second side, a top side and a bottom side, the housing defining a cavity having a first recessed region, the cavity begin disposed on the first end of the housing, the cavity shaped to accommodate a standard modular connector plug, the cavity and first recessed region together shaped to accommodate a modified modular connector plug with an additional set of contacts;

a first set of contacts, each contact having a first end and a second end, the first ends of the first set of contacts disposed along a first plane within the cavity proximate the first end of the housing, each first end of the first set of contacts providing a means for electrical coupling with the male connector plug, each second end of the first set of contacts providing a means for attachment to circuitry external to the housing; and a second set of contacts, each contact having a first end and a second end, the first ends of the second set of contacts being disposed along a second plane within the first recessed region of the cavity that is not coplanar with the first plane, each first end of the second set of contacts providing a means for electrical coupling with the male connector plug and being accessible through the first recessed region of the cavity, each second end of the second set of contacts providing a means for attachment to circuitry external to the housing.

2. The special purpose modular receptacle jack as recited in claim 1, wherein the first plane is perpendicular to a longitudinal axis of the housing.

3. The special purpose modular receptacle jack as recited in claim 1, wherein the second plane is parallel with the first plane.

4. The special purpose modular receptacle jack as recited in claim 1, wherein the second plane is perpendicular to the first plane.

5. The special purpose modular receptacle jack as recited in claim 1, wherein the first ends of the first set set of contacts are exposed within the cavity, the first ends of the second set of contacts are exposed within the recessed region of the cavity and the second ends of the first set and second set of contacts are exposed below the bottom side of the housing.

6. The special purpose modular receptacle jack as recited in claim 3, wherein the second end of the first set of contacts is coplanar with the second end of the housing.

7. The special purpose modular receptacle jack as recited in claim 6, wherein the first ends of the first set of contacts are disposed in parallel alignment with the first plane, and the second ends of the first set of contacts are disposed in parallel alignment with the second end of the housing.

8. The special purpose modular receptacle jack as recited in claim 1, wherein the first side of the housing has an inner surface that faces into and defines the cavity and the second plane is coplanar with the inner surface of the first side of the housing.

9. The special purpose modular receptacle jack as recited in claim 8, wherein the first ends of the second set of contacts are disposed upon the inner surface of the first side of the housing, the second set of contacts disposed in parallel alignment and staggered horizontally with respect to each other within the second plane.

10. The special purpose modular receptacle jack as recited in claim 8, wherein the first ends of the second set of contacts are disposed upon the inner surface of the first side of the housing, the second set of contacts disposed in parallel alignment and staggered vertically with respect to each other within the second plane.

11. The special purpose modular receptacle jack as recited in claim 1, wherein the second side of the housing has an inner surface that faces into and defines the cavity and further comprising a third set of contacts disposed in a third plane, the third plane parallel to the second side of the housing, the second side having an inner surface, the third set of contacts each having first ends and second ends, the first ends of which are disposed upon the inner surface of the second side of the housing.

12. The special purpose modular receptacle jack as recited in claim 11, wherein the third set of contacts are disposed in parallel alignment and staggered horizontally with respect to each other within the third plane.

13. The special purpose modular receptacle jack as recited in claim 11, wherein the third set of contacts are disposed in parallel alignment and staggered vertically with respect to each other within the third plane.

14. The special purpose modular receptacle jack as recited in claim 1, wherein the first side has an inner surface, the inner surface defining a channel, the first ends of the second set of contacts being disposed in parallel alignment and staggered horizontally within the channel.

15. The special purpose modular receptacle jack as recited in claim 11, wherein the inner surface of the second side defines a channel, the first ends of the third set of contacts being disposed in parallel alignment and staggered horizontally within the channel.

16. The special purpose modular receptacle jack as recited in claim 1, wherein the first side has an inner surface, the inner surface defining a channel, the first ends of the second set of contacts being disposed in parallel alignment and staggered vertically within the channel.

17. The special purpose modular receptacle jack as recited in claim 11, wherein the inner surface of the second side defines a channel, the first ends of the third set of contacts being disposed in parallel alignment and staggered vertically within the channel.

18. The special purpose modular receptacle jack as recited in claim 1, further comprising means for guiding the male connector plug during insertion into the receptacle jack.

19. The special purpose modular receptacle jack as recited in claim 18, wherein the means for guiding the male connector plug comprises:

an awning extending forward from the top side of the housing;

a first foot member extending forward from the first side and bottom side of the housing; and a second foot member extending forward from the second side and bottom side of the housing.

20. The special purpose modular receptacle jack as recited in claim 1, further comprising means for electrically coupling the receptacle jack to a printed circuit board.

21. The special purpose modular receptacle jack as recited in claim 1, further comprising means for attaching the receptacle jack to a printed circuit board.

* * * * *